United States Patent [19]

Passovoy

[11] 4,376,354

[45] Mar. 15, 1983

[54] DOOR FRAME ASSEMBLY

[75] Inventor: Richard H. Passovoy, San Ramon, Calif.

[73] Assignee: Anodex, San Ramon, Calif.

[21] Appl. No.: 237,826

[22] Filed: Feb. 25, 1981

[51] Int. Cl.[3] ..... E06B 1/04

[52] U.S. Cl. ..... 49/504

[58] Field of Search ..... 49/504, 505, 501

[56] References Cited

U.S. PATENT DOCUMENTS

| | | | |
|---|---|---|---|
| 3,287,856 | 11/1966 | Passovoy | 49/504 |
| 3,299,592 | 1/1967 | Cable | 49/504 X |
| 3,545,135 | 12/1970 | Lieber | 49/505 |
| 3,774,345 | 11/1973 | Cole et al. | 49/504 |
| 3,783,559 | 1/1974 | Yocum et al. | 49/504 |
| 3,964,214 | 6/1976 | Wendt | 49/504 X |
| 4,034,514 | 7/1977 | Cecil | 49/504 |
| 4,236,354 | 12/1980 | Passovoy | 49/504 |

*Primary Examiner*—Philip C. Kannan

*Attorney, Agent, or Firm*—Townsend and Townsend

[57] ABSTRACT

The present invention is an improved prefabricated door assembly including a frame member, hinges, strike plates, and cover plates. The frame member is formed of a web having a first and second longitudinally extending portion and side flanges extending from the lateral edges of the web to circumscribe the wall. The web defines two slots extending the length of the frame and generally aligned substantially normal to each other. The hinges include hinge plates having two projecting tongues to engage the frame in the above slots. The strike plates and cover plates similarly include projecting tongues to engage the slots of the frame, so that the entire assembly results in a frame with a smooth, continuous, and pleasing surface.

The web of the frame frequently includes a longitudinally-extending ridge complementary to a smaller, longitudinally extending groove on the plates, which induces flexion of the plates and results in better locking of the plates in the frame.

16 Claims, 9 Drawing Figures

DOOR FRAME ASSEMBLY

BACKGROUND OF THE INVENTION

1. Field of the Invention

The present invention relates to door frame assemblies and particularly to prefabricated door frame assemblies.

2. Summary of the Prior Art

The use of prefabricated metal door frames has become quite common in both interior and exterior building construction and various different types of prefabricated frames and frame assemblies have been developed and used over the years. One of the more common types of prefabricated frames includes a frame member (which includes a web spanning the door opening in the wall and flanges extending from the edges of the web to circumscribe the opening), plus separate hinges and strike plates attached to the frame by conventional screw fasteners. Serious disadvantages of this type of prefabricated frame however, are the necessity of cutting the frame at the construction site to install the hinge plates and strike plate and the subsequent manual labor required to insert the numerous screw fasteners attaching the hinges and strike plates to the frame.

Other prefabricated door frames have been developed which avoid some of these problems but which have other disadvantages. In a frame such as that described in Cable, U.S. Pat. No. 3,299,592, the necessity of cutting the frame to install the hinges is avoided by providing counter-sunk areas or slots in the frame to which the hinges are spot welded. However, in the Cable frame, the hinges thus must be attached to the frame at the pre-set countersunk or slotted locations, preventing the convenient use of pre-hinged doors which may or may not have appropriately-located hinges. In addition, the existence of preset locations for the hinges requires the production of different models of the frame for left and right swinging doors.

In prefabricated door frame assemblies such as that depicted in Passovoy, U.S. Pat. No. 3,287,856, the frame assembly includes a frame member to which the hinges and strike plates can be attached at any location, plus cover plates attachable to the incomplete frame member to "finish" it where the hinges and strike plates are not attached. Although this assembly allows the use of pre-hinged doors, the use of conventional screw fasteners to attach the hinge and strike plates still requires considerable manual labor. A similar problem is encountered with the prefabricated door frame assemblies described in Yocum, et al., U.S. Pat. No. 3,783,559, and Cole, U.S. Pat. No. 3,774,345. The Yocum assembly, in fact, requires even more manual labor for installation because the cover plates, too, are attached by screw fasteners.

The prefabricated door frame assembly depicted in Passovoy, U.S. Pat. No. 4,236,354 minimizes the manual labor involved in installation of the assembly and allows the use of pre-hinged doors, but has other disadvantages. This assembly includes frame members having two transversely aligned parallel serrated slots to which prefabricated hinges having parallel serrated projecting tongues engageable with the slots are attached by inserting the tongues in the slots of the frame member. Similarly attachable cover plate sections and strike plates are also included. A problem with the Passovoy assembly, however, is that the hinge plates may tend to detach from the frame member, the tongues sliding out of the slots under stress.

SUMMARY OF THE INVENTION

The present invention is an improved prefabricated door frame assembly which eliminates many of the disadvantages of prior door frame assemblies described above.

In one aspect of the invention the present door frame assembly includes a frame member formed of a web including a first and second longitudinally-extending portion, and side flanges extending from the lateral edges of the web to circumscribe the wall, the web also including two slots extending its length and aligned substantially normal to each other. Also included are prefabricated hinges including hinge plates, each having two projecting tongues adapted to engage and mate with the slots in the web of the frame member for attachment of hinge plate to the frame member.

The first slot in the web is usually transversely aligned in the center of the web, substantially in the plane of the (usually planar) first portion of the web, and opening toward the web's second portion. The second slot is usually aligned normal to the first in a shoulder forming part of the web's second portion, proximate its lateral edge. The first tongue of the hinge plate normally extends from and in the plane of the plate itself, and the other tongue projects perpendicular to the plate. Strike plates and cover plate sections having similar tongues engageable with the slots are also provided for installation in the frame member. The cover plates are adapted to be cut for insertion in the frame member between the hinge plates and between the hinge plates and strike plates and the ends of the frame member to finish the frame member and provide an assembled frame with a smooth, continuous and pleasing surface.

The alignment of the second slot and tongue normal to the first slot and tongue minimizes possibility of detachment of the hinge plates from the frame member upon stress to the door, but still allows the use of pre-hinged doors and obviates the considerable manual labor involved in installing conventional screw fasteners. In addition, a single assembly can be used for the installation of both left and right-swinging doors.

In another aspect, the frame assembly of the present invention includes a frame member having a longitudinally-extending ridge borne on the outer surface of a section of the second portion of the web, the web in this aspect also being formed of a first and second longitudinally extending portion, and including two longitudinally extending slots for insertion and attachment of the hinge plates, cover plate sections, and strike plates which include tongues complementary to the slots. The ridge-bearing section of the web is located between the slots in the web and the hinge plates (and cover and strike plates) include a groove complementary to but smaller than the ridge. Also, in this aspect of the invention, the first slot of the frame member is usually transversely aligned proximate the center of the web, opening toward the web's second portion. This first slot is normally aligned substantially in the plane of the (usually planar) first portion of the web but has an inner wall offset toward the wall from the outer surface of the ridge-bearing section, so that the first slot is slightly wider than its respective tongue of the hinge plates, strike plate, and cover plate sections.

This particular construction results in slight outward flexion of the hinge plates themselves upon installation, to minimize detachment of the hinge plates from the frame member, as the hinge plate itself absorbs stress by flexing. In the preferred embodiment, the slots and tongues are aligned normal to each other to further prevent detachment of the hinge plates from the frame member.

DETAILED DESCRIPTION OF THE SPECIFIC EMBODIMENTS

Figure 2:
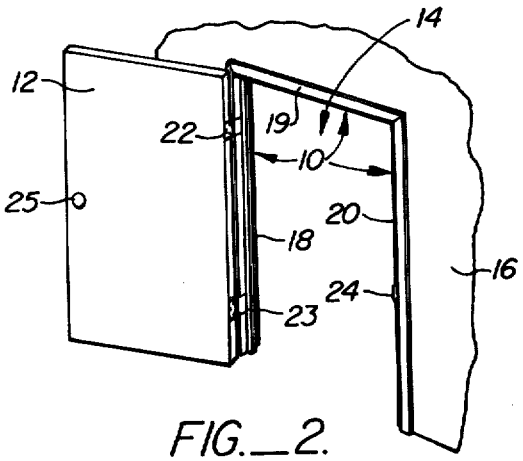
FIG. 2 is a perspective view of a door installed using the door frame assembly of the present invention.

Referring first to FIG. 2, an installed door frame assembly of the present invention can be seen, the assembly comprising frame assembly 10 circumscribing an opening 14 in a wall 16 with a door 12 rotatably attached thereto by hinges 22 and 23. Door frame assembly 10 includes three frame members 18–20 covering the sides and top of door opening 14, with a pair of hinges 22 and 23 attached to frame member 18 so that door 12 swings in a clockwise direction when viewed from the top (i.e., so that door 12 is a "right-swinging" door). A strike plate 24 adapted to engage a latch actuated by knob 25 is attached to frame member 20 at the opposite side of opening 14 from frame member 18.

Figure 1:
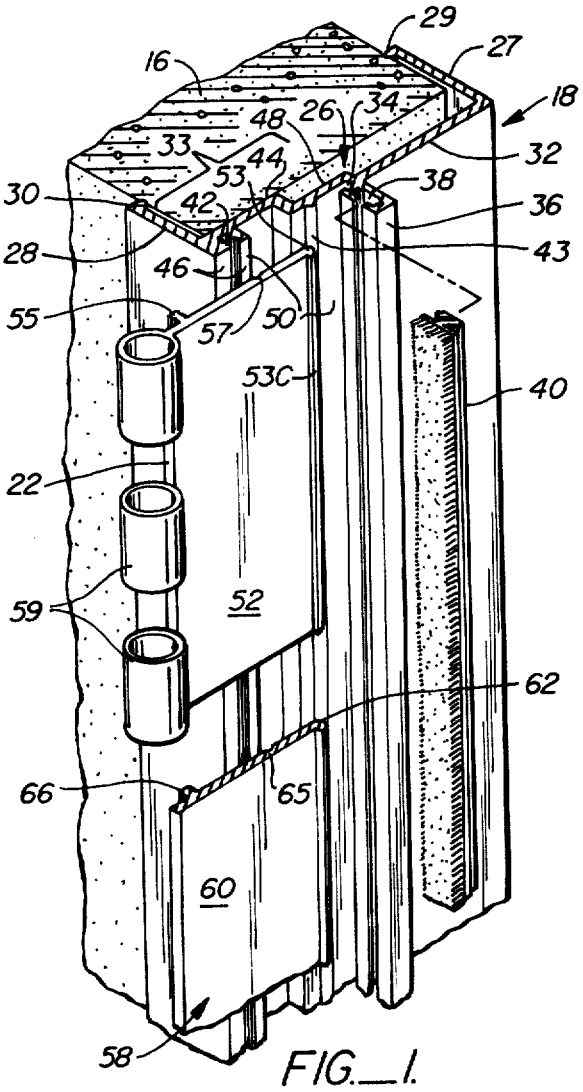
FIG. 1 is a fragmentary, exploded perspective view of the preferred embodiment of the present invention showing installation of the hinges and the cover plate.
Figure 3:
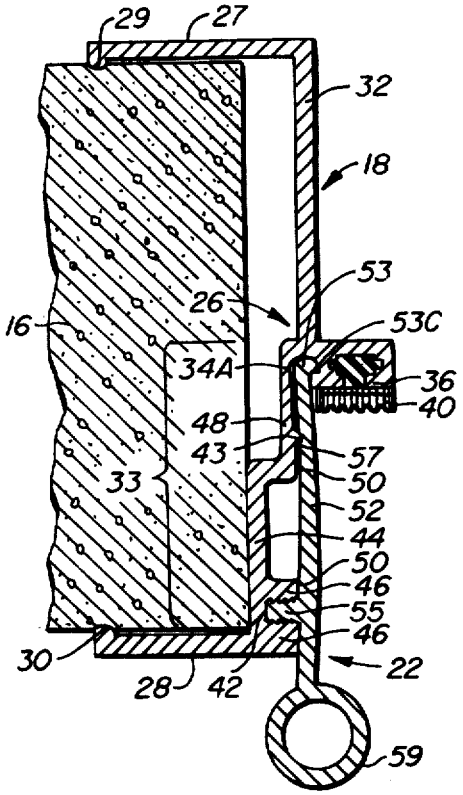
FIG. 3 is a sectional plan view of the preferred embodiment of the present invention depicting the installation of a hinge plate in the frame member.
Figure 4:
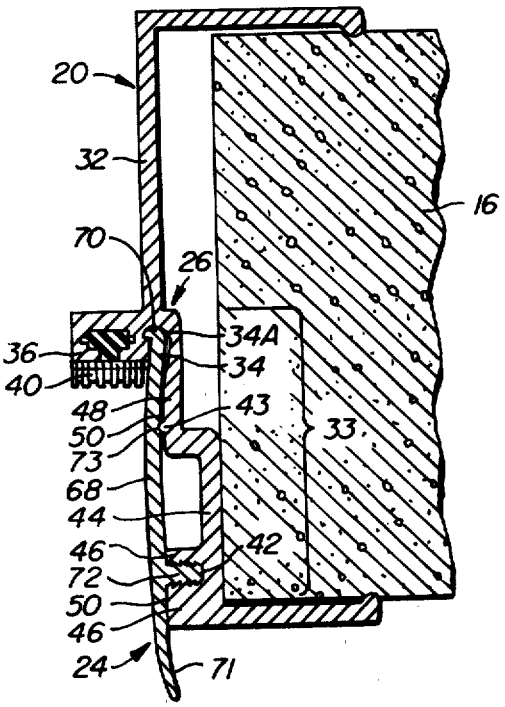
FIG. 4 is another sectional plan view of the preferred embodiment of the present invention illustrating the installation of a strike plate in the frame member.
Figure 5B:
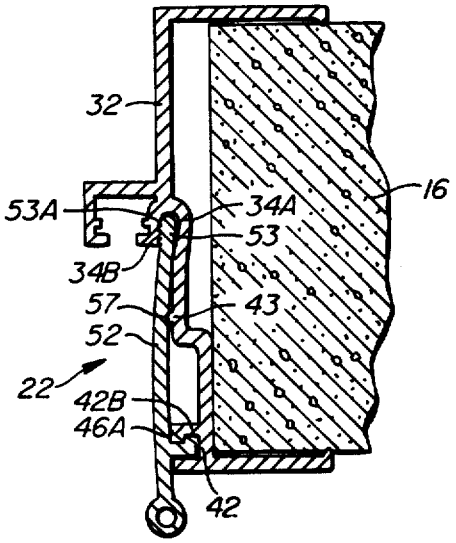
FIGS. 5A and 5B are sectional plan views of preferred alternate embodiments of the present invention, also depicting installation of a hinge plate in the frame member.
Figure 5A:
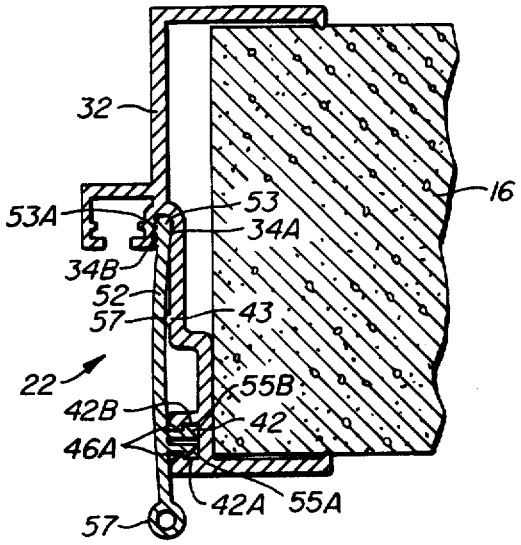
Figure 8:
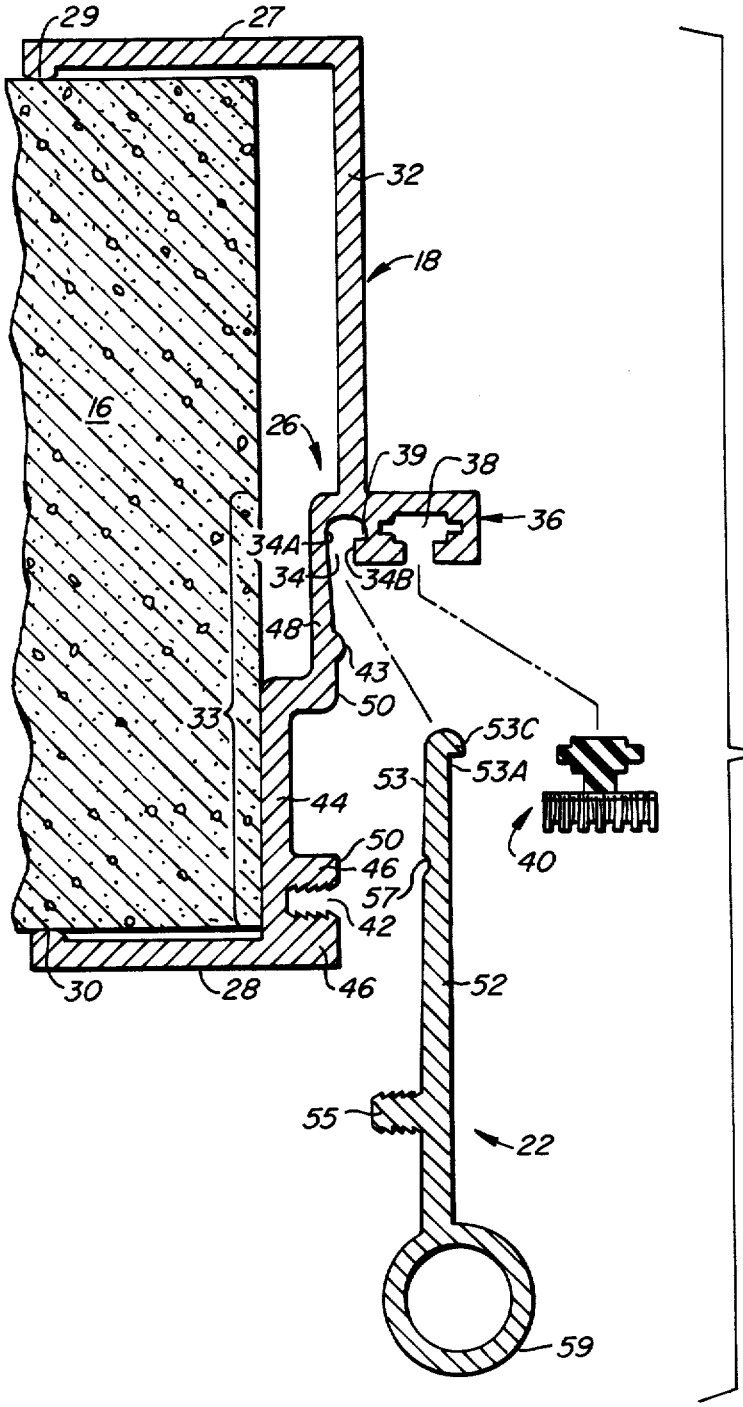
FIG. 8 is an exploded sectional plan view of the preferred embodiment of the present invention depicting relationships between the hinge, the doorstop, and the frame.

Referring to FIGS. 1, 3, 4 and 8 in combination, the preferred embodiment of door frame assembly 10 is shown in more detail, while FIGS. 5A and 5B illustrate preferred alternate embodiments. In FIGS. 1, 3, and 8 (and 5A and 5B), a door frame member 18 is shown and in FIG. 4, door frame member 20 is shown, but all of the door frame members (18, 19, and 20) are identical metal extrusions in any given embodiment.

Each frame member such as 18 includes a central web 26 spanning the width of wall 16 and a pair of side flanges 27 and 28 bearing on their inner sides projecting ribs 29 and 30 at the extreme end so that the frame member can be installed by snapping it over the end of wall 16. Web 26 includes a first, usually planar, longitudinally-extending portion 32 and a second usually non-planar, portion 33 with a longitudinally-extending door stop abutment 36 centrally located at the juncture of the first and second portions.

Second portion 33 of the web usually includes a recessed planar section 44 flat against wall 16, a shoulder 46 at its lateral edge, and raised planar section 48 adjacent the door stop abutment 36. The outer surface of section 48 and shoulder 46 usually defines a planar surface 50 spaced slightly inwardly (by an amount usually equivalent to the thickness of first planar portion 32) from first portion 32 of the web. The outer surface of section 48 preferably bears a ridge 43 extending the length of the frame member. Doorstop abutment 36 includes a longitudinally extending slot 38 opening toward second web portion 33 in which a resilient door stop pad 40 can be installed, so that the door 12 will always be attached by hinges to the second portion 33 of the web.

At approximately the center of web 26 toward the wall from door-stop abutment 36, a transversely aligned slot 34 opening toward second portion 33 of the web is formed, which extends the length of the frame member 18. In the preferred embodiment, slot 34 is rounded in configuration and includes a longitudinally extending recess 39 in outer slot wall 34B, in FIGS. 5A and 5B, (illustrating preferred alternate embodiments of the present invention) outer slot wall 34B has a serrated configuration. Where section 48 includes ridge 43, as preferred, inner wall 34A of slot 34 is usually offset toward the wall from the plane of planar portion 32 and the outer surface of section 48.

Shoulder 46 defines a second longitudinally-extending slot 42 which is aligned substantially normal to first slot 34. Slot 42 is preferably of a serrated configuration, as shown in FIGS. 1, 3, 4 and 8, but can sometimes include longitudinally extending recesses in side walls 42A and 42B or only in inner side wall 42B as shown in FIGS. 5A and 5B; where such recesses are included, the outer surface 46A of shoulder 46 is configured to inwardly incline toward slot 42.

Hinge 22 includes a hinge plate 52 adapted to attach to the frame assembly. Hinge plate 52 has a lateral edge opposite to rings 59 which provides a first tongue 53 adapted to project into and engage slot 34 in frame member 18. Where slot 34 includes a recess in slot wall 34B (as in FIGS. 1, 3 and 8) tongue 53 includes projection 53C on its outer surface 53A to engage the recess 39; where outer slot wall 34B is serrated (as in FIGS. 5A and 5B) the outer surface 53A of tongue 53 is complementarily serrated. Hinge plate 52 further includes a second tongue 55 projecting from its inner surface normal to tongue 53, to engage slot 42 in the frame member. Where slot walls 42A and 42B are serrated (as in FIGS. 1 and 3) tongue 55 is complementarily serrated; where slot walls 42A and 42B, or only slot wall 42B include recesses (as shown in FIGS. 5A and 5B) tongue 55 includes complementary projections 55A and 55B, or only 55B, to engage the slot. In addition, the inner surface of hinge plate 55 includes a groove 57 slightly smaller than but complementary to ridge 43 on the frame member.

Thus, hinge 22 can be readily installed on frame member 18 (or frame member 20, for a "left-swinging" door, since all frame members are identical) at any point along the length of the frame member after the frame member has been installed, by snapping the tongues on the hinge plate into the slots in the frame member. Recessed inner wall 34A of slot 34 allows particularly convenient insertion of tongue 53 of hinge plate 52 into slot 34. The thickness of hinge plate 52 is such that when the hinge plate is installed, except for engagement rings 59, the visual appearance of frame member 18 is very similar on both sides of door stop abutment 36.

The alignment of tongue 55 and respective slot 42 substantially normal to tongue 53 and slot 34 provides significant advantages over prior art frame assemblies such as that depicted in Passovoy, U.S. Pat. No. 4,236,354 where the tongues (and slots) are aligned parallel to each other. In the prior assembly, the hinge plates may tend to detach from the frame member, sliding out of their respective slots in the direction of the door opening when stress is applied to the door; however, in the present invention, the positioning of tongue 55 and slot 42 tends to prevent such detachment.

The provision of groove 57 in hinge plate 52 together with slightly larger ridge 43 on the frame member particularly in combination with recessed slot wall 34A (the "groove-ridge-recessed slot wall" configuration) further minimizes the tendency of the hinge plates to detach upon application of stress by providing flexibility in the hinge plate so that the plate itself (rather than the tongue-slot engagements) absorbs more stress. Once installed, hinge plate 52 tends to flex outwardly from the wall, as shown in FIGS. 3, 5A and 5B, with tongue 55 positioned slightly toward recessed inner wall 34A in slot 34. Upon application of stress to the hinge member, the plate 32 itself tends to flex and absorb stress which would otherwise be placed on the tongue-slot engagement.

A plurality of cover plate sections such as 58 are also provided as part of door frame assembly 10 of the present invention. The cover plate sections 58, as shown in FIG. 1, include planar portion 60 having tongues 62 and 66 similar to those of hinge plate 22 and configured to engage and mate with slots 34 and 42 of the frame member. The cover plate sections also include a groove 65 on the inner side of planar portion 60, smaller than but complementary to ridge 43. The cover plate sections are installed in the frame member in the same fashion as the hinge plates in areas between the hinge plates and between the hinge plates and the end of the frame member. The planar portion 60 of cover plate section 58 is approximately the same thickness as the hinge plate to provide a frame with a finished and aesthetically pleasing appearance with fastener elements entirely concealed from view.

The installation of the strike plate 24 in frame member 20 (which is identical to frame members 18 and 19) in the preferred embodiment is illustrated by way of reference to FIG. 4. Strike plate 24 includes a planar portion 68, usually of the same thickness as as the hinge plates, having tongues 70 and 72 similar in configuration to tongues 53 and 55 of the hinge plates, and adapted to engage and mate with slots 34 and 42 of the frame member. The inner side of planar portion 68 of strike plate 24 includes a groove 73 complementary to but smaller than ridge 43 of the frame member. Strike plate 24 also includes a curved projection 71 which accomodates the sliding latch member used to keep the door in its closed position. Strike plate 24 is thus installed in the frame member at any location in the same fashion as the hinge plates and cover plate sections, and cover plate sections are installed between the strike plate and the ends of the frame member to provide a finished frame with a pleasing appearance.

Figure 6:
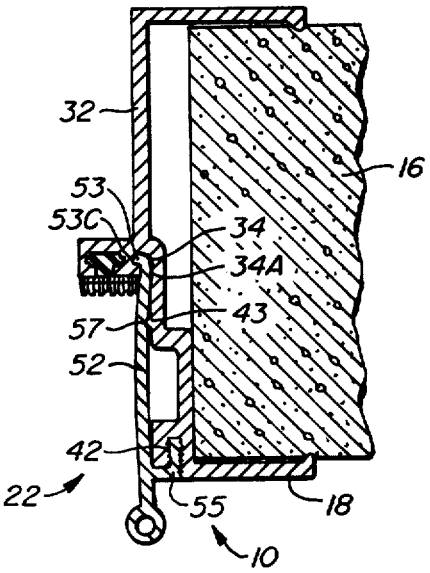
FIG. 6 is a sectional plan view of another embodiment of the second aspect of the present invention, illustrating installation of a hinge plate in the frame member.
Figure 7:
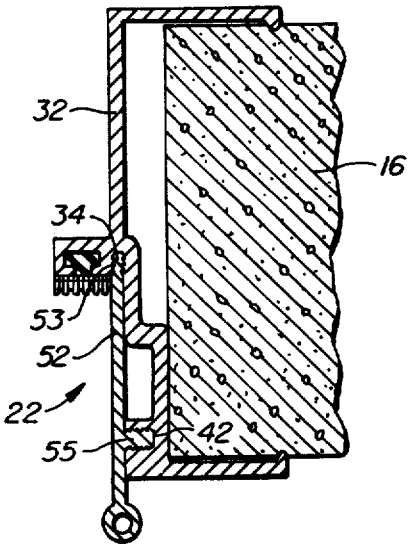
FIG. 7 is a sectional plan view of another embodiment of the first aspect of the invention illustrating installation of a hinge plate in the frame member.

Referring to FIGS. 6 and 7, installation of the hinge plates in the frame member in an alternate embodiment of the present invention are depicted. FIG. 6 illustrates a door frame assembly 10 of the present invention having the "groove-ridge-recessed slot wall" configuration of the present invention in combination with a frame assembly having a configuration similar to that described in Passovoy, U.S. Pat. No. 4,236,354. The assembly includes a frame member 18 having two parallel, transversely aligned slots 34 and 42 of a serrated configuration, slot 42 offset from slot 34 toward the wall and hinge plates 22 (and a strike plate and cover plate sections) having complementary parallel tongues 53 and 55 to engage and mate with slots 34 and 42 of the frame member. Frame member 18 also includes a ridge 43 parallel to the slots on the outer surface of section 48 of the web's second portion, and the inner wall 34A of slot 34 is recessed toward the wall from planar portion 32 of the web and the outer surface of ridge-bearing section 48; the hinge plate 22, (as well as the cover plate sections and strike plate) include a groove 57, on the inner side of the plate 52 complementary to but smaller than ridge 43. The groove-ridge-recessed slot wall configuration in combination with this frame assembly minimizes the otherwise-existing tendency of the hinge plates to detach from the frame member upon application of stress, the plates in the present invention tending to flex to absorb stress themselves.

Referring finally to FIG. 7, another alternate embodiment of the present invention is depicted in which projecting tongues 55 on the hinge plate 22 (as well as on the cover plate sections and strike plate) and slots 42 of the frame member are aligned substantially normal to transversely-aligned slot 34 and tongue 53, but the groove-ridge recessed-slot wall configuration is absent. This alignment of the tongues and complementary slots relative to each other tends to prevent the hinge plates from detaching from the frame member under stress, but this embodiment is naturally not as preferable as that including the groove-ridge recessed-slot wall configuration combination as well.

In all the depicted embodiments, frame members 18, 19, and 20 can be cut from a single piece of stock extrusion at the construction site to fit the particular door opening 14 in wall 16. Since frame members 18, 19 and 20 are identical, hinges 22, 23 can be installed on any of the frame members at any position along their length to accommodate various size and shape doors, and left and right swinging door applications. Strike plate 24 can similarly be installed where desired. After installation of the hinges and strike plate 24, cover plate sections 58 are cut to fit the spaces between the hinges and the spaces between the hinges and strike plate and the ends of the frame members. The mechanisms by which the cover plate sections 58, hinges 22, 23 and strike plate 24 are attached to frame members 18–20 is completely hidden from view. Both sides of frame members 18, 19 and 20 with equipment attached appear virtually identical, and the completed assembly forms a finished, aesthetically pleasing structure.

While several embodiments of the present invention have been illustrated in detail, it is apparent that modifications and adaptations of the embodiments will occur to those skilled in the art. However, it is to be expressly understood that such modifications and adaptations are within the spirit and scope of the present invention, as set forth in the following claims.

What is claimed is:

1. Apparatus for constructing a door frame in an opening formed in a wall to accommodate a door, such apparatus comprising:

a frame member including a central web adapted to span the width of the wall and a pair of side flanges extending from the lateral edges of the web and adapted to fit over the edges of the wall circumscribing the opening, said web formed of first and second longitudinally-extending portions and including first and second longitudinally-extending slots, the first slot located proximately central relative to the web, and the second slot aligned normal to the first proximate the lateral edge of the web's second portion;

at least two hinge members each having a hinge plate which includes a first and a second elongate tongue adapted to engage and mate with the respective slots in the frame member so that the hinge members can be attached to the frame member where desired after installation of the frame member in the opening, the second tongue aligned substantially normal to the first tongue to minimize detachment of the hinge plate from the frame member under stress; and a plurality of cover plate sections, each including a first and second elongate tongue adapted to engage and mate with the respective slots in the frame member, the cover plate sections adapted to be cut to fit the gaps between the hinge plates and the ends of the frame member to provide a finished aesthetically pleasing door frame.

2. Apparatus according to claim 1 and wherein the first portion of the web is planar and terminates in the first slot, the first slot being transversely aligned relative to the web and substantially coplanar with the plane of the first portion of the web.

3. Apparatus according to claim 2 and wherein the web's second portion includes a section between the slots having an outer surface bearing a longitudinally extending ridge, and the hinge plates and cover plate sections each include a groove complementary to but smaller than said ridge to promote flexion of said hinge plates to minimize detachment of the hinge plates from the frame member under stress.

4. Apparatus according to claim 3 and wherein the first slot includes an inner wall and an outer wall, and the inner wall of the first slot is offset toward the wall from the outer surface of the ridge-bearing section of the web and the plane of the first portion of the web to provide a first slot slightly wider than the first tongues, to further promote flexion of the hinge plates and minimize detachment of the hinge plates from the frame member under stress.

5. Apparatus according to claim 1 or 2 and additionally comprising a strike plate having a first and second elongate tongue adapted to engage and mate with the respective slots in said frame member so that the strike plate can be mounted to the frame member where desired after installation of the frame member in the opening, and wherein said cover plate sections are cut to fit between the strike plate and the ends of the frame member to provide an aesthetically pleasing, finished, door frame.

6. Apparatus according to claim 3 or 4 and additionally comprising a strike plate having a first and second elongate tongue adapted to engage and mate with the respective slots in the frame member, said strike plate further including a groove complementary to but smaller than the ridge of the frame member so that the strike plate can be mounted to the frame member where desired after installation of the frame member in the opening, and wherein cover plate sections are cut to fit between said strike plate and the ends of the frame member to provide an aesthetically pleasing, finished, door frame unit.

7. Apparatus for constructing a door frame in an opening formed in a wall to accommodate a door, said apparatus comprising:

a frame member including a central web adapted to span the width of the wall and a pair of side flanges extending from the lateral edges of the web and adapted to fit over the edges of the wall circumscribing the opening, said web formed of first and second longitudinally extending portions and including first and second longitudinally-extending slots, the first slot centrally located and transversely aligned relative to the web, and opening toward the second portion of the web, the second slot located proximate the lateral edge of the second portion of the web, the second portion of the web including a section between said slots having an outer surface bearing a longitudinally-extending ridge;

at least two hinge members each having a hinge plate which includes first and second elongate tongues adapted to engage and mate with the respective slots in the frame member so that the hinge members can be attached to the frame member where desired after installation of the frame member in the opening, the hinge plate also including a groove complementary to but smaller than the ridge of the frame member to promote flexion of the hinge plates and minimize detachment of the plates from the frame member under stress; and a plurality of cover plate sections each including a pair of elongate tongues adapted to engage and mate with the respective slots in the frame member, and a groove complementary to but smaller than said ridge, said cover plate section adapted to cut to fit the gaps between hinge plates and the ends of the frame member to provide an aesthetically pleasing door frame.

8. Apparatus according to claim 7 and wherein the web's first portion is planar and terminates in the first slot, the first slot being aligned in the plane of the web's first portion and having an inner and an outer slot wall, the inner slot wall offset toward the wall from the plane of the web's first portion and the outer surface of the ridge-bearing section of the web, to provide a first slot slightly wider than the first tongues, so that flexion of the hinge plates upon installation is promoted to further minimize detachment of the hinge plates from the frame member under stress.

9. Apparatus according to claim 7 and wherein the slots in the frame member are each transversely aligned relative to said web, the second slot being offset toward the wall from the first.

10. Apparatus according to claim 7 and wherein the second slot in the frame member is aligned substantially normal to the first slot, to further minimize detachment of the hinge plates from the frame member under stress.

11. Apparatus according to claim 7 and additionally comprising a strike plate having first and second elongated tongues adapted to engage and mate with the respective slots in the web, and including a groove in the plate complementary to but smaller than the ridge in the frame member so that the strike plate can be mounted to the frame member where desired after installation of the frame member in the opening, and wherein said cover plate sections are cut to fit between the strike plate and the ends of the frame member, to provide a finished door frame unit.

12. Apparatus for providing a door frame in an opening formed in a wall to accommodate a door said apparatus comprising:

a frame member including a central web adapted to span the width of the wall and a pair of side flanges extending from the lateral edges of the web and adapted to fit over the edges of the wall circumscribing the opening, said web formed of first and second longitudinally extending portions, the first portion being planar and terminating in a first slot, the first slot substantially coplanar with the plane of the first portion and opening toward the second portion of the web, the second portion of the web including a second slot aligned normal to the first and located proximate the lateral edge of the second portion;

at least two hinge members each having a planar hinge plate having two elongate tongues adapted to engage and mate with the slots in the web so that the hinge members can be located where desired and attached to the frame member after installation of the frame member in the opening with minimized tendency to detach from the frame member under stress; and a plurality of cover plate sections each including a generally planar portion having a pair of elongate tongues adapted to engage and mate with the respective slots in the web, the cover plate sections adapted to be cut to fit the gaps between hinge plates and the ends of the frame member to provide an aesthetically pleasing finished door frame.

13. Apparatus according to claim 12 and additionally comprising a strike plate including a generally planar portion having a pair of elongate tongues adapted to engage and mate with the slots of the frame member, for installation where desired on the frame member, and wherein the cover plate sections are cut to fit between the strike plate and the ends of the frame member.

14. Apparatus for providing a door frame in an opening formed in a wall to accommodate a door, said apparatus comprising:

a frame member including a central web adapted to span the width of the wall and a pair of side flanges extending from the lateral edges of the web and adapted to fit over the edges of the wall circumscribing the opening, said web formed of first and second longitudinally-extending portions, the first portion being planar and terminating in a first slot having an inner and an outer slot wall, the first slot aligned substantially in the plane of the first portion and opening toward the second portion of the web, the second portion of the web including a second slot aligned normal to the first and located proximate the lateral edge of the second portion, the second portion also including a section between the slots having an outer surface bearing a longitudinally extending ridge, the inner slot wall of the first slot being offset toward the wall from the outer surface of the ridge-bearing section of the web and the plane of the web's first portion;

at least two hinge members each having a planar hinge plate having two elongate tongues adapted to engage and mate with the slots in the web and a groove complementary to but smaller than the ridge of the web, so that the hinge members can be located where desired and attached to the frame member after installation of the frame member in the opening with minimized tendency to detach from the frame member under stress; and a plurality of cover plate sections each including a generally planar portion having a pair of elongate tongues adapted to engage and mate with the respective grooves in the web and a groove complementary to but smaller than the ridge of the web, the cover plate sections adapted to be cut to fit the gaps between hinge plates and the ends of the frame member to provide an aesthetically pleasing finished door frame.

15. Apparatus according to claim 14 and additionally comprising a strike plate including a generally planar portion having a pair of elongate tongues adapted to engage and mate with the slots of the frame member and a groove complementary to but smaller than the ridge of the web for installation where desired on the frame member, and wherein the cover plate sections are cut to fit between the strike plate and the ends of the frame member.

16. In a prefabricated door frame assembly for construction of a door frame in a door opening in a wall including (i) a frame member comprising a web spanning the width of the opening and formed of a first longitudinally extending planar portion and a second longitudinally-extending non-planar portion, and two side flanges extending from the lateral edges of the web to circumscribe the wall at the opening, the web including first and second parallel, commonly-opening slots transversely aligned relative to the web, the first slot aligned in the plane of the web's first portion proximate the center of the web and opening toward the web's second portion, and the second slot offset toward the wall from the first, proximate the lateral edge of the web's second portion; (ii) at least a pair of hinge members including a planar hinge plate having first and second elongate tongues adapted to engage and mate with their respective slots in the frame member; (iii) a strike plate having first and second elongate tongues adapted to engage and mate with their respective slots in the frame member; and (iv) cover plate sections having first and second elongate tongues adapted to engage and mate with their respective slots in the frame member, the cover plate sections adapted to be cut to attach to the frame member between the hinge plates and strike plate and the ends of the frame member; the improvement which comprises:

(a) in the frame member, a longitudinally-extending ridge borne on the outer surface of a section of the web's second portion between the slots, and an inner wall of the first slot recessed from the outer surface of the ridge-bearing section and the plane of the web's first portion, so that the first slot is wider than the respective tongues of the hinge plates, cover plate sections, and strike plate; and (b) in the hinge plates, strike plate, and cover plate sections, a groove formed in the plates and complementary to but smaller than the ridge of the frame member, so that upon installation in the frame member, the plates tend to flex outwardly from the wall to minimize detachment of the hinge plates from the frame member under stress.

* * * * *